US011116300B2

(12) United States Patent
Mody

(10) Patent No.: US 11,116,300 B2
(45) Date of Patent: Sep. 14, 2021

(54) TENSION SPRING ASSISTED PROTECTIVE COVER

(71) Applicant: CASE-MATE, INC., Atlanta, GA (US)

(72) Inventor: Saumil Chetan Mody, Atlanta, GA (US)

(73) Assignee: CASE-MATE, INC., Atlanta, GA (US)

( * ) Notice: Subject to any disclaimer, the term of this patent is extended or adjusted under 35 U.S.C. 154(b) by 0 days.

(21) Appl. No.: 16/743,562

(22) Filed: Jan. 15, 2020

(65) Prior Publication Data

US 2020/0229566 A1 Jul. 23, 2020

Related U.S. Application Data

(60) Provisional application No. 62/794,443, filed on Jan. 18, 2019.

(51) Int. Cl.
*A45C 11/00* (2006.01)
*A45C 13/00* (2006.01)

(52) U.S. Cl.
CPC ..... *A45C 13/007* (2013.01); *A45C 11/00* (2013.01); *A45C 2011/001* (2013.01); *A45C 2011/002* (2013.01); *A45C 2011/003* (2013.01)

(58) Field of Classification Search
CPC . A45C 13/007; A45C 11/00; A45C 2011/001; A45C 2011/002; A45C 2011/003
See application file for complete search history.

(56) References Cited

U.S. PATENT DOCUMENTS 4,984,706 A * 1/1991 Cadwell ..... E05D 11/105 220/829
10,064,298 B2 * 8/2018 Cavenagh ..... H05K 5/0021
2007/0227923 A1 * 10/2007 Kidakarn ..... G06F 1/1681 206/320
2008/0083631 A1 * 4/2008 Tsang ..... A45C 11/18 206/320
2009/0233658 A1 * 9/2009 Murayama ..... H04M 1/022 455/575.3
2014/0290009 A1 * 10/2014 Kasai ..... E05D 3/12 16/386
2016/0234951 A1 * 8/2016 Chen ..... G06F 1/1626
2018/0295736 A1 10/2018 Cavenagh et al.

OTHER PUBLICATIONS

Case-Mate ATT010925 Pantech Breeze II Tough Case; 2011; 1 pg.

* cited by examiner

*Primary Examiner* — Corey N Skurdal
(74) *Attorney, Agent, or Firm* — Gardner Groff & Greenwald, PC

(57) ABSTRACT

A protective and/or ornamental case for a foldable handheld electronic device. The case includes a front shell and a back shell pivotally connected to one another by one or more springs or other tension mechanisms. A first portion of an electronic device is inserted into the front shell and a second portion of the electronic device is inserted into the back shell. The tension mechanisms retain the front and back shells operatively engaged with one another as the electronic device housed in the case is pivotally or hingedly opened and closed, help prevent unintended opening or closing of the device, and keep the device open or closed when so positioned by a user.

14 Claims, 6 Drawing Sheets

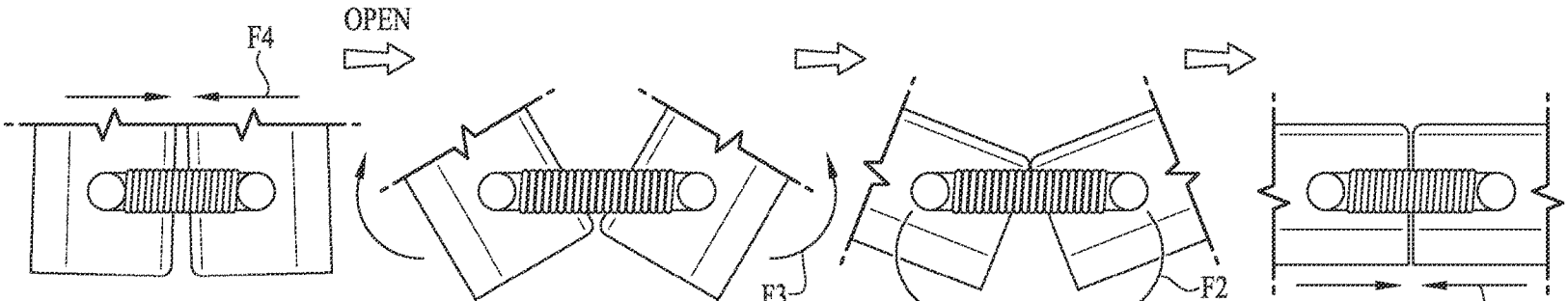
FIG. 6A
FIG. 6B
FIG. 6C
FIG. 6D
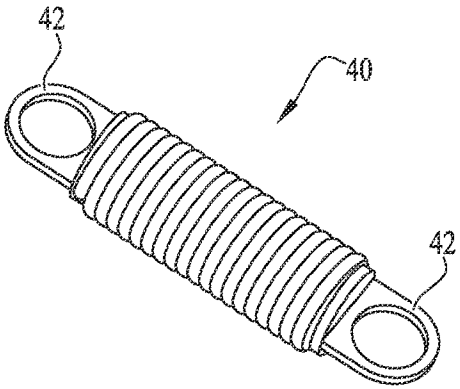
FIG. 8
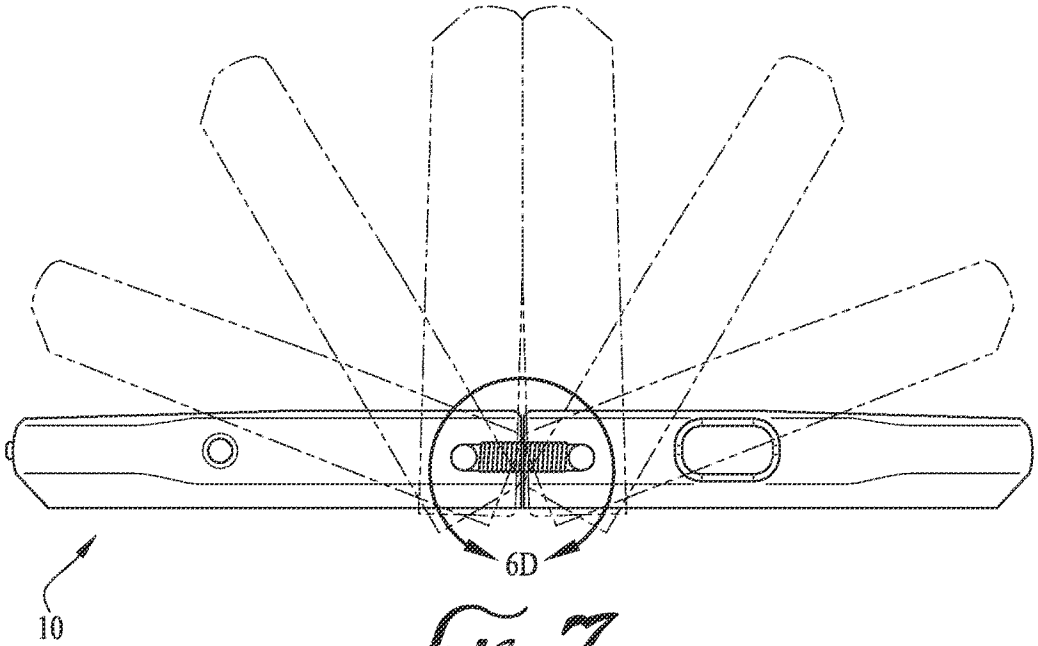
FIG. 7

TENSION SPRING ASSISTED PROTECTIVE COVER

CROSS-REFERENCE TO RELATED APPLICATION

This application claims the benefit of U.S. Provisional Patent Application Ser. No. 62/794,443 filed Jan. 18, 2019, the entirety of which is hereby incorporated herein by reference for all purposes.

TECHNICAL FIELD

The present invention relates generally to the field of protective covers for electronic devices, and more particularly to a tension spring assisted foldable protective cover for a portable foldable electronic device.

BACKGROUND

Protective and/or decorative cases are used in connection with portable electronic devices such as cell phones, smart phones, electronic readers, handheld game devices and the like. It is to the provision of a tension spring assisted folding protective cover for a foldable portable electronic device that the present invention is primarily directed.

SUMMARY

In example embodiments, the present invention provides a tension spring assisted protective cover for a portable foldable electronic device having a first housing and a second housing. The case comprises two jackets or shells coupled by one or more tension mechanisms or spring biasing elements, wherein a first shell is configured to receive the first housing of the electronic device and a second shell is configured to receive the second housing of the electronic device. The first and second shells generally comprise a back or base panel and a sidewall or frame extending substantially about the periphery of the base panel. The first and second shells further comprise one or more holding posts or members located on the exterior surface of the top and bottom sidewalls and extending externally therefrom. The holding posts are configured to receive the tension mechanisms wherein one end of the tension mechanism is connected to one holding post of the front shell by means of a first engagement feature and the other end of the tension mechanism is connected to one holding post of the back shell by a second engagement feature.

In one aspect, the present invention relates to a cover for a foldable electronic device including one or more tension or biasing elements to assist the user keep the device in fully open or fully closed positions when intended, and to prevent unintended opening or closing of the device.

In another aspect, the invention relates to a case for a foldable electronic device, the case including a front or first shell having a rigid back panel and a peripheral frame. One or more holding posts preferably protrude externally from the exterior surface of the peripheral frame. The case further includes a back or second shell having a rigid back panel and a peripheral frame. One or more holding posts preferably protrude externally from the exterior surface of the peripheral frame. The case preferably further includes one or more tension mechanisms, wherein one end of the tension mechanism is connected to the holding post of the front shell by means of a first engagement feature and the other end of the tension mechanism is connected to the holding post of the back shell by a second engagement feature.

In still another aspect, the invention relates to a case for a foldable electronic device, the case including a front shell, a back shell, one or more tension elements, and a protective plate or panel for the device's hinge. The hinge protection plate includes a base panel with a top end and a bottom end, a top wall extending transversely from the top end, and a bottom wall extending transversely from the bottom end. In example embodiments, the hinge protection plate is configured such that bores in the top and bottom walls concentrically align with the tension mechanisms affixed to top and bottom holding posts on the front and back shells.

In another aspect, the invention relates to a foldable case for at least partially housing a foldable electronic device. The foldable electronic device preferably has a first device portion, a second device portion, and a hinged device coupling between the first and second device portions allowing a pivotal range of motion between the first and second device portions. The foldable case preferably includes a first case portion configured to at least partially house the first device portion when the case is installed on the device, a second case portion configured to at least partially house the second device portion when the case is installed on the device, and engagement means between the first case portion and the second case portion. The engagement means preferably maintains a biasing force between the first and second case portions and retains the first and second case portions in operative engagement with one another through the pivotal range of motion when the case is installed on the device.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

BRIEF DESCRIPTION OF THE DRAWINGS

FIGS. 6A-6D show additional detail of the tension spring and forces applied on the cover shells, according to an example embodiment, as the cover moves from a closed configuration to an open configuration.

FIG. 7 shows the relative positions of the front and back shells of FIG. 3 in a fully open, semi-open, semi-closed, and fully closed position.

FIG. 8 is a perspective view of a tension spring according to an example embodiment.

DETAILED DESCRIPTION OF EXAMPLE EMBODIMENTS

Figure 2:
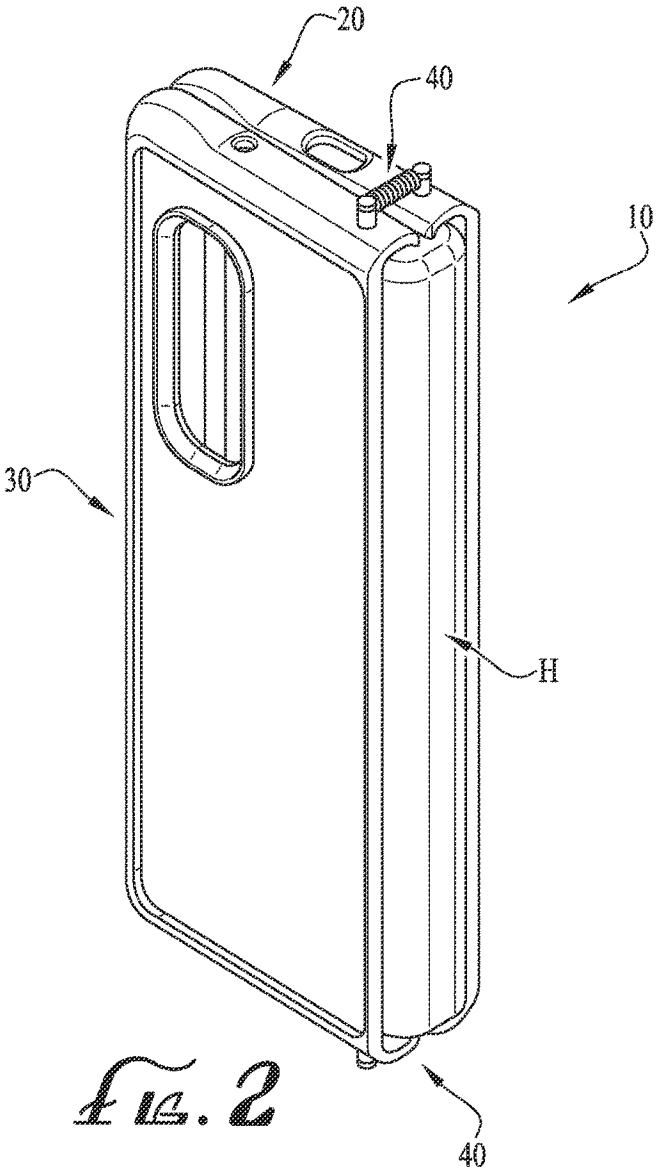
FIG. 2 is a perspective view of the cover of FIG. 1 in a closed position.

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-4 show a foldable protective case or cover 10 for a foldable portable electronic device D, according to an example embodiment of the present invention. In the depicted embodiment, the case or cover 10 includes a housing for receiving and at least partially covering the foldable electronic device. In example embodiments, the case or cover 10 is configured to fit a foldable smart-phone, tablet computer, cell phone, MP3 player, music and/or video player, electronic reader, handheld game device, or other foldable portable electronic device. Case 10 generally comprises a first or front jacket or shell 20, a second or back jacket or shell 30, and one or more tension or spring mechanisms 40 operatively engaged between the front and back shells. In example forms, the front and back jackets 20, 30 are at least partially formed of polycarbonate or other hard plastic, metal, composite, polymeric, ceramic, and/or other material(s) of construction.

Figure 1:
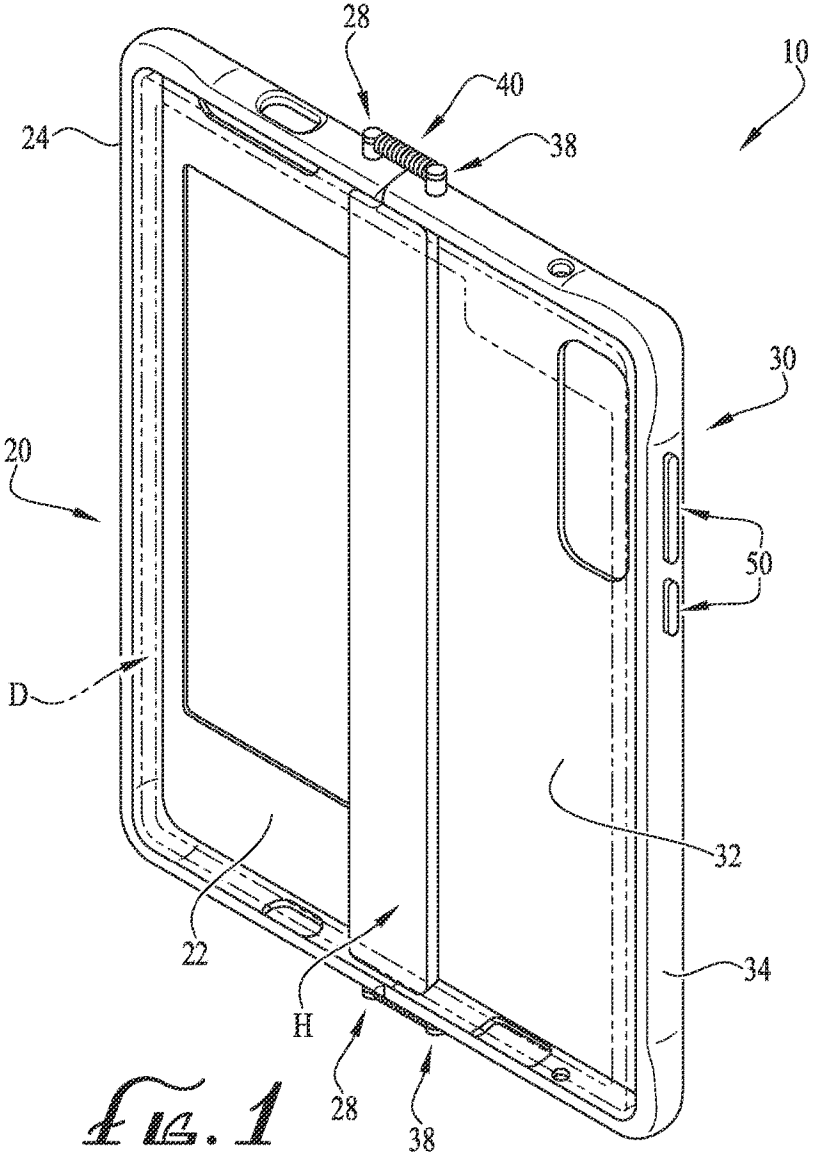
FIG. 1 is a perspective view of a tension spring assisted protective cover or case for a foldable portable electronic device in an open position, according to an example embodiment of the present invention.

As shown in FIG. 1, the front shell 20 generally comprises a front plate or base panel 22 and a raised sidewall 24. In the depicted embodiment, the sidewall 24 projects transversely outward along the top edge, the bottom edge, and a first or outer side edge of the base 22, forming a continuous sidewall 24 with two radiused corners partially bounding an interior chamber for receiving an electronic device. The sidewall 24 preferably comprises a ridge or flange along its perimeter at its distal rim that extends inwards towards the center of the shell 20 to help retain the case on an electronic device. In the depicted embodiment, the front base panel 22 is generally flat and generally rectangular with rounded corners, but in alternate embodiments may comprise different configurations to match the shape of a particular electronic device for which the case is configured. In yet other embodiments, the sidewall 24 comprises two or more separate sidewalls extending from discrete sections of the base periphery resulting in a plurality of discrete sidewalls.

Figure 4:
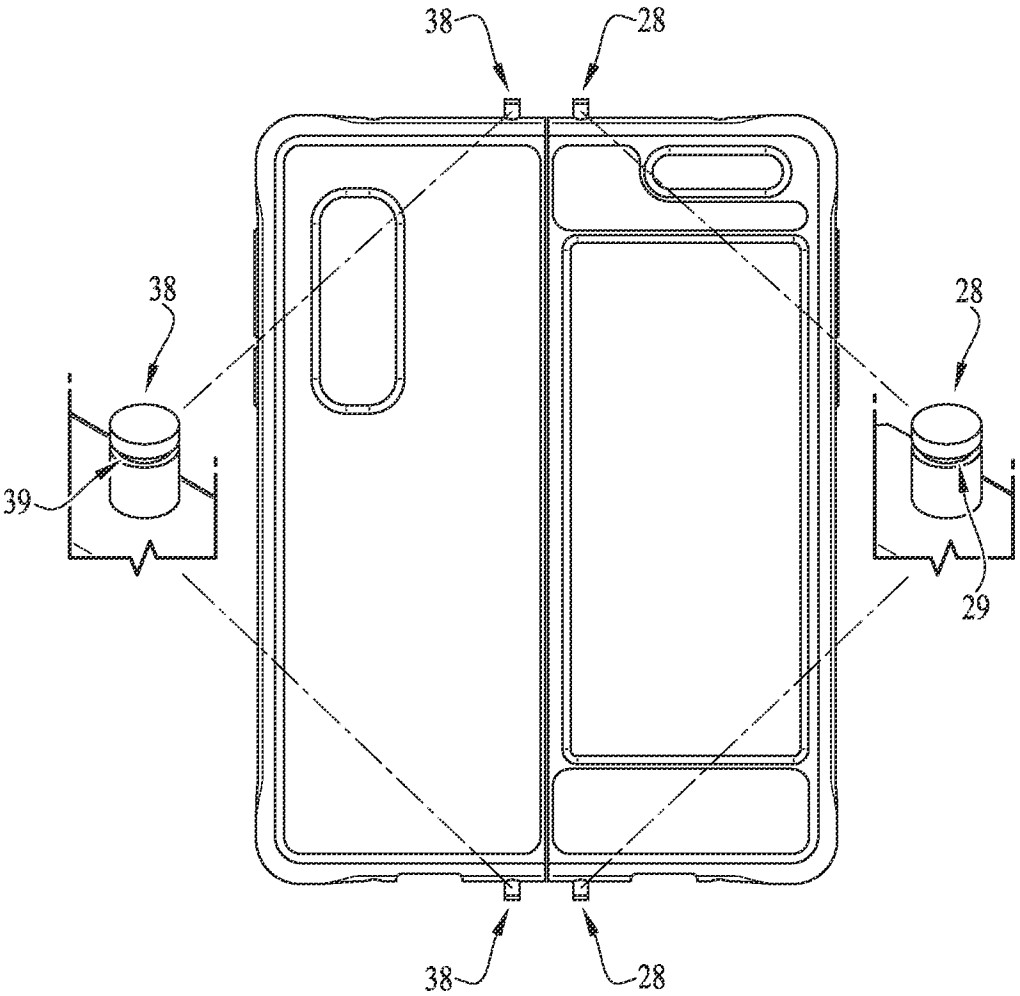
FIG. 4 is a back view of the cover of FIG. 1 and shows detail views of holding posts on the exterior of the cover.

The front shell 20 further comprises one or more biasing element retainers or retention elements, for example in the form of holding posts or support members 28, as shown in FIGS. 1 and 4. In alternate embodiments, the biasing element retainers may be in the form of a recess, projection or other surface feature, and/or a coupling, connector or other attachment means, for coupling a spring or other biasing element to the front shell 20. In the depicted embodiment, one holding post 28 is located on the top sidewall of jacket 20 and extends externally therefrom. A second holding post 28 is located on the bottom sidewall of jacket 20 and extends externally therefrom. The two posts 28 are preferably located near the side of base 22 opposite the first side edge. The posts 28 further comprise a groove or channel 29 along the perimetric surface, as shown in the detail view of FIG. 4. In the depicted embodiment, the posts 29 comprise a cylindrical shape or a circular cross-section; however, the cross-sectional shape of posts 28 can comprise of various geometric shapes, such as for example, rectangle, triangle, star, and the like.

The back shell 30 generally comprises a back plate or base panel 32 and a raised sidewall 34. In the depicted embodiment, the sidewall 34 projects transversely outward along the top edge, the bottom edge, and a first side edge of the base 32, forming a continuous sidewall 34 with two radiused corners partially bounding an interior chamber for receiving the electronic device. The sidewall 34 preferably comprises a ridge or flange along its perimeter at its distal rim that extends inwards towards the center of the shell 30 to retain the case in place on an electronic device. Back base 32 is generally flat and rectangular with rounded corners, but it may comprise different configurations to match the shape of a particular electronic device in alternate embodiments. In yet other embodiments, the sidewall 34 comprises two or more separate sidewalls extending from discrete sections of the base periphery resulting in a plurality of discrete sidewalls.

The back shell 30 further comprises one or more biasing element retainers or retention elements, for example in the form of holding posts or support members 38, as shown in FIGS. 1 and 4. In alternate embodiments, the biasing element retainers may be in the form of a recess, projection or other surface feature, and/or a coupling, connector or other attachment means, for coupling a spring or other biasing element to the front shell 30. In the depicted embodiment, one holding post 38 is located on the top sidewall of jacket 30 and extends externally therefrom. A second holding post 38 is located on the bottom sidewall of jacket 30 and extends externally therefrom. The two posts 38 are preferably located near the side of base 32 opposite the first side edge. The posts 38 further comprise a groove or channel 39 along the perimetric surface, as shown in the detail view of FIG. 4. In the depicted embodiment, posts 38 comprise a cylindrical shape or a circular cross-section; however, the cross-sectional shape of posts 38 can comprise various geometric shapes, such as for example, rectangle, triangle, star, and the like.

Figure 3:
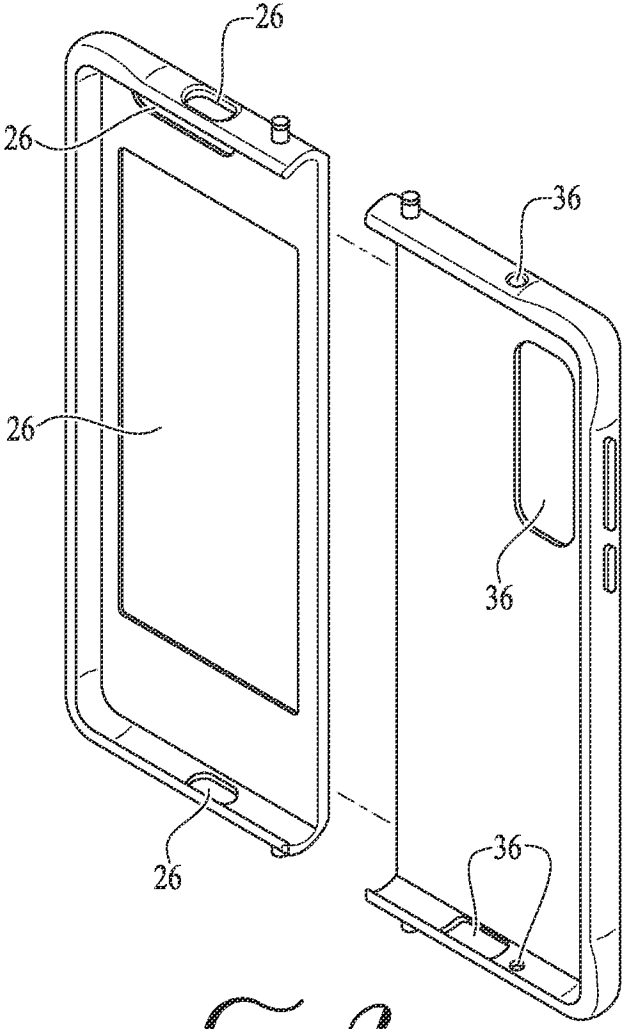
FIG. 3 is a perspective assembly view of the front and back cover shells of the cover of FIG. 1.

The front and back bases 22, 32 and sidewalls 24, 34 optionally include one or more cutouts or apertures 26 and 36 extending therethrough, as shown in FIG. 3. Apertures 26 and 36 are positioned such that buttons, switches, ports, touch-screen(s), camera lenses, microphones, and/or other user interfaces or mechanisms on an electronic device installed into the case 10 can be accessed and operated therethrough.

The front and/or back shells 20, 30 can additionally include one or more buttons 50 positioned in the cutouts of the shells, as shown in FIG. 1, wherein the buttons 50 are configured to engage buttons on the device such as the volume controls and power button. The buttons 50 can include a T-shaped retaining feature configured to engage a flange on the front and back shells to keep the buttons 50 engaged with the shells. In the example embodiments, buttons 50 are formed of polycarbonate or other injection molded material.

In example embodiments, one or more biasing elements or engagement means such as tension or spring mechanisms 40 are installed on the case 10 by securing a first distal end of the tension mechanism to one support post 28 on the front shell 20 and securing a second distal end of the tension mechanism to a support post 38 on the back shell 30. In the depicted embodiments, the biasing elements or tension mechanisms 40 are tension springs, as shown in FIG. 8. The first and second distal ends of the tension springs comprise engagement features 42 in the form of a loop or ring. In alternate embodiments, the biasing elements or engagement means may comprise an elastic cord, band, strip, living hinge and/or other elastically resilient member, a helical, coil, torsion, leaf or other form of extension or compression spring, one or more magnetic and/or magnetically-attracted elements, a gravity-assisted or manual closure mechanism, and/or other form of biasing or engagement means. In yet other embodiments, engagement features 42 are in the form of hooks and/or clips. In further alternate embodiments, the ends of the spring or other tension member engage within recesses or other retention elements or engagement features on the front and back shells, or are secured by adhesive, fasteners or other attachment means.

The springs or other tension mechanisms 40 are installed onto case 10, connecting together the front and back shells 20, 30 via support posts 28, 38. Engagement feature 42 of the first distal end of spring mechanism 40 is fitted over groove 29 of support post 28. Engagement feature 42 of the second distal end of spring mechanism 40 is fitted over groove 39 of the support post 38. According to example embodiments, loop 42 at the first distal end of tension spring 40 is contoured over support post 28 and nestled into groove 29. Similarly, loop 42 at second distal end of tension spring 40 is contoured over support post 38 and adjusted to fit securely in groove 39. In the depicted embodiments, one tension spring 40 with loop features 42 is connected to holding posts 28 and 38 located on top sidewalls 24 and 34 of front and back shells 20, 30, and a second tension spring 40 is connected to holding posts 28 and 38 located on the bottom sidewalls 24 and 34 of the front and back shells 20, 30. In alternate embodiments, a single biasing spring 40 may be provided at either the top or the bottom of the case 10, and a pivotal hinge mechanism at the other of the top or bottom of the case.

In use, the user installs the case 10 onto a foldable electronic device having a first housing and a second housing, where the first housing and the second housing are connected by a hinge element H. The user installs the front shell 20 onto the device's first housing and the back shell 30 onto the second housing of the device. In an example method of use, the first housing of a foldable electronic device is inserted into front shell 20 such that the exterior of the first housing fits snugly within the sidewall 24 and front panel 22. The flange of sidewall 24 helps retain the device within shell 20. Similarly, the second housing of the device is inserted into the back shell 30 such that the exterior of the second housing fits snugly between sidewall 34 and back panel 32, and the second housing is further retained by the flange of sidewall 34. The hinge or fulcrum geometry of the case 10 generally corresponds to the hinge or fulcrum geometry of the folding electronic device intended to be housed in the case, whereby the relative pivotal or folding movement of the case shells 20, 30 substantially matches the relative pivotal or folding movement of the corresponding folding elements of the device for smooth operation and closely conforming fit.

In example embodiments, a foldable electronic device is generally capable of pivotal movement through a range of motion including the depicted four relative positions—fully closed, semi-closed, semi-open, and fully open—as shown in FIGS. 5A-D and FIG. 7. FIGS. 6A-D show detail views of tension mechanism 40 in the four positions collectively shown in FIG. 7, and depict a sequence of opening (FIGS. 5A to 5D and FIGS. 6A to 6D) and closing (FIGS. 5D to 5A and FIGS. 6D to 6A) the device within the case or cover 10 according to example methods of use.

Figures 5A, 5B, 5C, 5D:
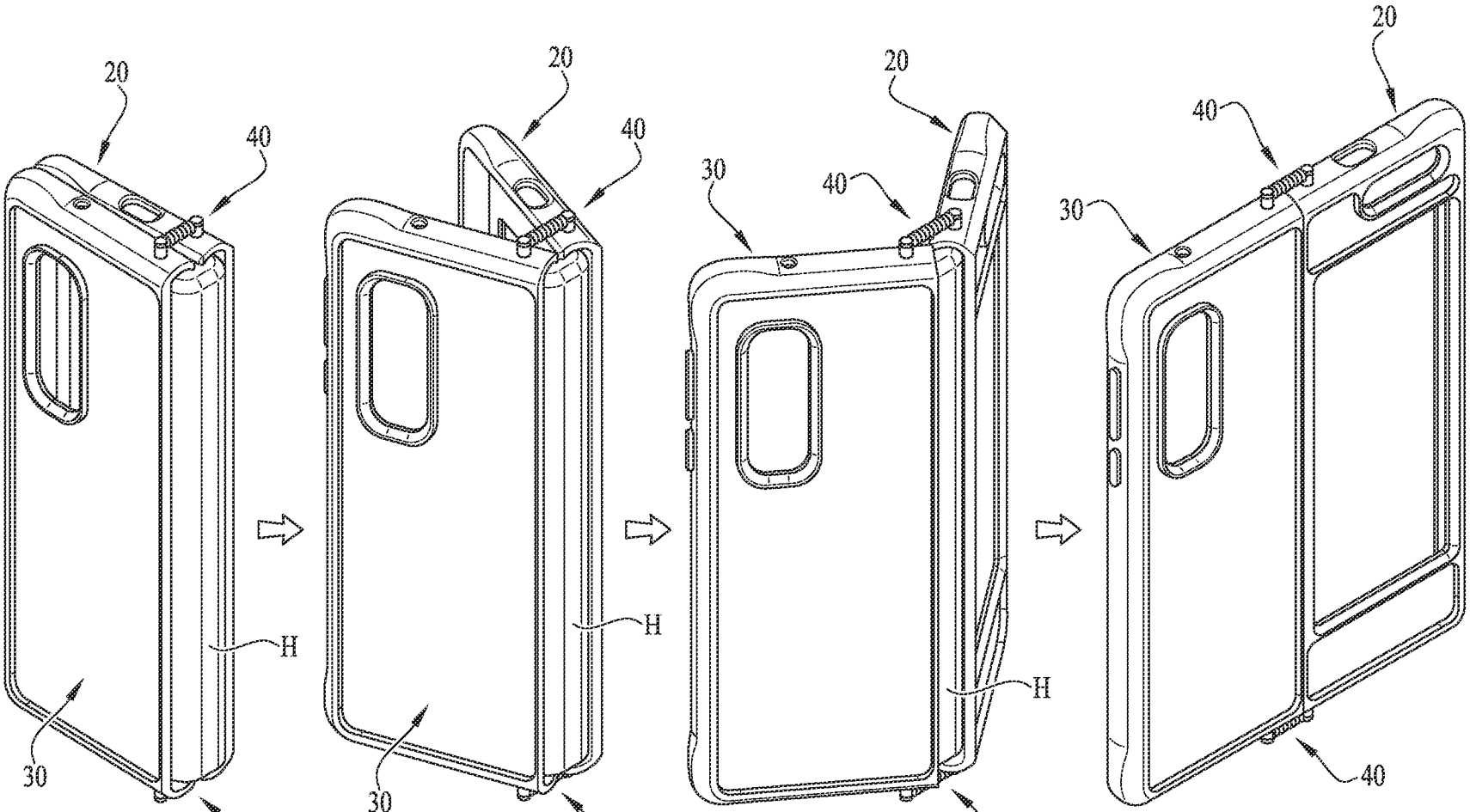
FIGS. 5A-5D show a sequence of operation of a cover according to an example embodiment, moving from a closed configuration to an open configuration.

In an example method of use, spring 40 is under tension when the case and electronic device are in a fully closed position (FIGS. 5A, 6A). The tensional load on spring 40 biases the case 10 toward the fully closed position, and resists external forces to spread apart the top and bottom shells 20, 30 rotationally about a fulcrum point fixed by the device's hinge. As the user applies greater force and overcomes the resistance, the front and back shells 20, 30 spread apart about the device's hinge. As the angle between the front and back shells 20, 30 increase (FIGS. 5B, 5C and FIGS. 6B, 6C), the location of the tensional force between holding posts 28 and 29 moves relative to the fulcrum points 25, 35 and determines the direction of the resulting rotation, as shown in FIG. 9.

Figure 9:
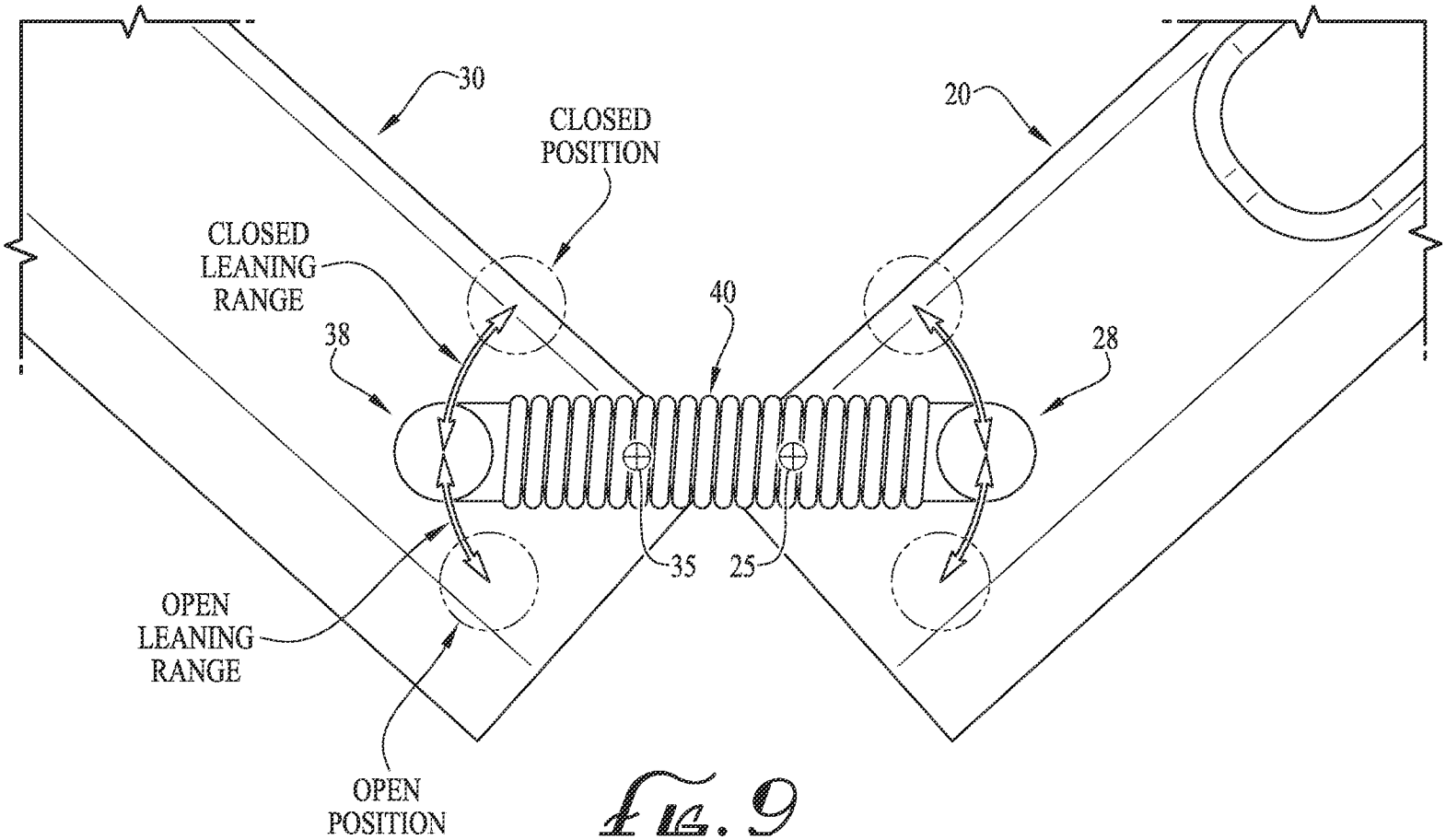
FIG. 9 shows the relative positions of holding posts and the associated fulcrum points in a fully open, semi-open, semi-closed, and fully closed position.

A semi-closed position, as shown in FIG. 9, refers to any configuration of case 10 where the tensional force vector or line is above or forward of a line extending through the fulcrum points 25, 35 of the shells 20, 30 as the shells rotate or pivot relative to one another along an opening and/or closing range of motion constrained by the device's fixed hinge. In a semi-closed position, the tension in the spring will cause rotation of the top and bottom shells to return the case to a fully closed position. A semi-open position refers to any configuration of case 10 where the spring mechanism is below or behind the fulcrum points 25, 35, as depicted in FIG. 9. In a semi-open position, the tension in the spring will apply a force to both top and bottom shells causing rotation about their respective fulcrum points 25, 35 to bias the device toward the fully open position (FIGS. 5D, 6D).

Figure 11B:
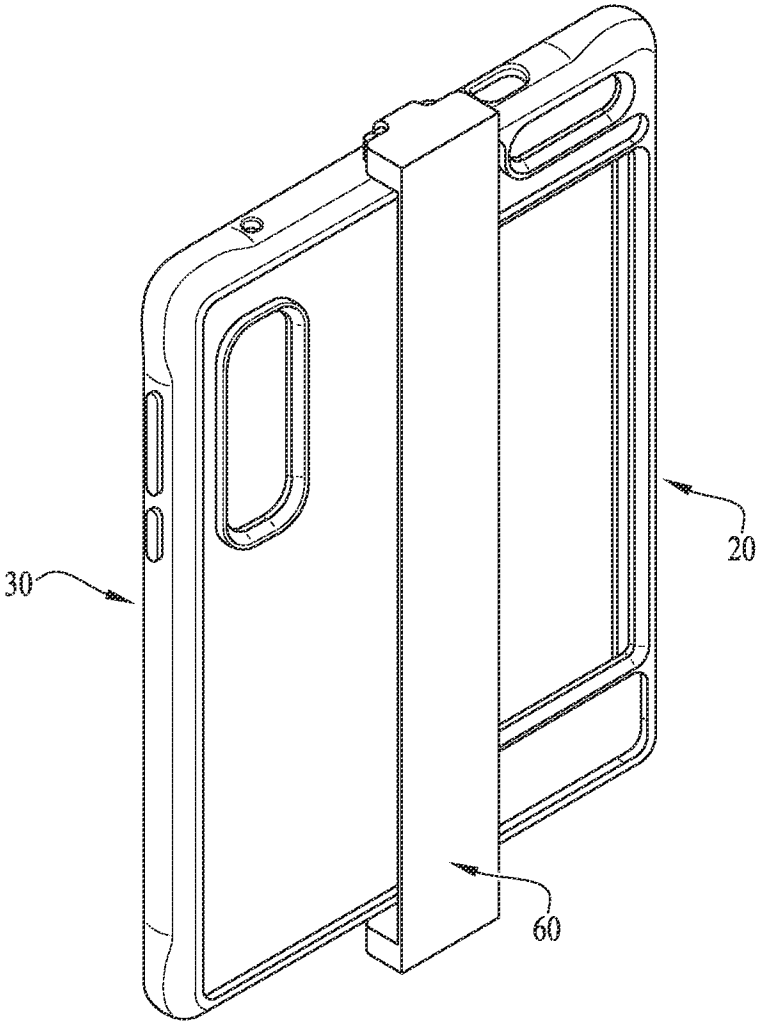
FIG. 11B shows the hinge cover plate of FIG. 10 attached to the cover of FIG. 1 in a fully open position.
Figure 11A:
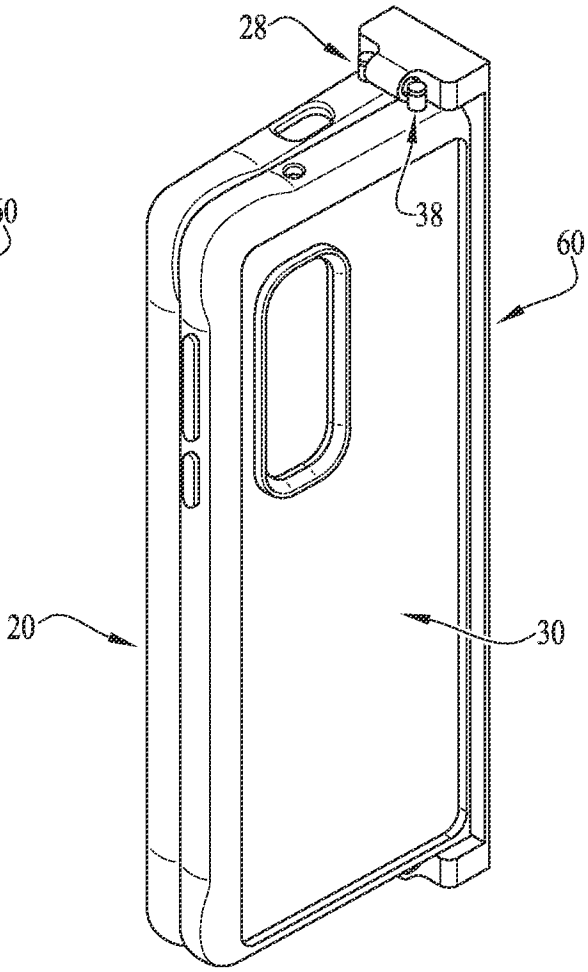
FIG. 11A shows the hinge cover plate of FIG. 10 attached to the cover of FIG. 1 in a fully closed position.
Figure 10:
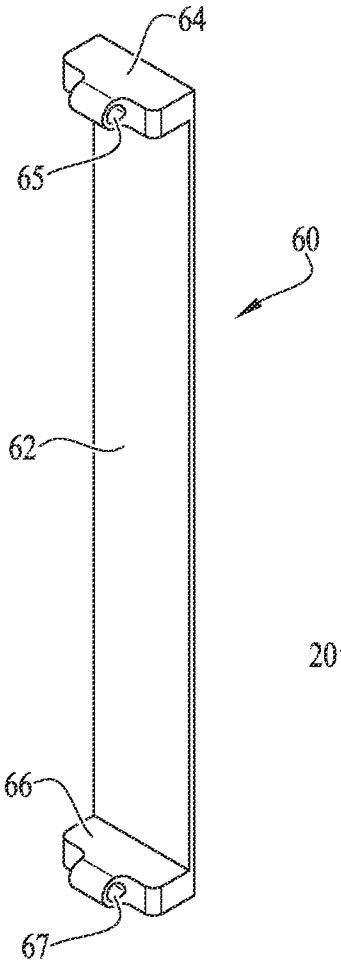
FIG. 10 is a perspective view of an optional hinge cover plate.

In further example embodiments of the present invention, the case 10 optionally comprises an hinge protection plate or panel 60, as shown in FIGS. 10 and 11. According to example embodiments, the hinge protection panel 60, when provided, comprises a generally flat base 62 with a top end and a bottom end. A top wall or frame 64 extends transversely from the top end of the base and includes a top bore or channel 65 for containing or covering the upper spring 40 or biasing element. Similarly, a bottom wall or frame 66 extends transversely from the bottom end of the base and includes a bottom bore or channel 67 for containing or covering the lower spring 40 or biasing element. In example embodiments, as shown in FIGS. 11A-B, the hinge protection panel 60 is configured such that the top bore 65 aligns concentrically with spring 40 between the holding posts 28 and 38 on the top ends of front and back shells 20, 30 and the bottom bore 67 aligns concentrically with spring 40 between holding posts 28 and 38 on the bottom ends of the front and back shells 20, 30. In this manner, spring(s) 40 engaged between engagement posts at the top and/or bottom of the first and second shells 20, 30 extend through the respective top and/or bottom channels 65, 67 to retain and bias the first and second shells, while shielding against user contact with the spring(s) and at potential pinch points between the shells.

In example embodiments, the first and second shells, and the hinge protection plate can be formed from polycarbonate or other hard plastics, thermoplastic polyurethane or other soft plastics, metal, composite, ceramic, and/or other material(s) of construction. In particular embodiments, the components of the case 10 optionally comprises a hard and durable outer shell for impact resistance, for example comprising polycarbonate (PC) or other hard plastic; and a softer cushioning inner layer or lining, for example comprising thermoplastic polyurethane (TPU) for shock absorption, to provide improved protection to the electronic device housed in the case. In further example embodiments, the case optionally also comprises an inner frame or wall that conforms to the inner surfaces of sidewalls 24 and 34. The inner frame preferably comprises a resilient or compressible material such as silicon, rubber, elastomer or the like, to cushion the electronic device from impacts and assist in retaining the case or cover in place on an electronic device contained therein.

While the invention has been described with reference to example embodiments, it will be understood by those skilled in the art that a variety of modifications, additions and deletions are within the scope of the invention, as defined by the following claims.

What is claimed is:

1. A case for attachment on a foldable electronic device, the case comprising:

a first shell comprising a first back panel and a first peripheral frame extending at least partially around the first back panel, and further comprising at least one first retention element positioned on the first peripheral frame;

a second shell comprising a second back panel and a second peripheral frame extending at least partially around the second back panel, and further comprising at least one second retention element positioned on the second peripheral frame;

at least one tension member connected between the first and second retention elements, the at least one tension member retaining the first and second shells in operative engagement with one another as they move through a range of motion between an open configuration and a closed configuration; and a device hinge protection plate, wherein the device hinge protection plate includes a top wall with a first bore extending therethrough and a bottom wall with a second bore extending therethrough, and wherein a first tension member extends through the first bore and a second tension member extends through the second bore.

2. The case of claim 1, wherein at least one of the first and second shells comprise a hard plastic portion and a soft plastic portion.

3. The case of claim 1, further comprising at least one case button, wherein the case button is operably aligned with a user input actuator of the electronic device when the case is installed on the device.

4. The case of claim 1 , wherein the at least one tension member comprises a spring.

5. The case of claim 1, wherein the at least one tension member comprises an elastic band.

6. The case of claim 1, wherein the front shell and the back shell define one or more apertures positioned to align with corresponding features of the electronic device.

7. The case of claim 1, wherein the first and second retention elements comprise holding posts protruding from the first and second shells, each of the holding posts comprising a groove for receiving cooperative engagement features of the tension member.

8. A case for attachment on a foldable electronic device, the case comprising:

a first shell comprising a first back panel and a first peripheral frame extending at least partially around the first back panel, and further comprising at least one first retention element positioned on the first peripheral frame;

a second shell comprising a second back panel and a second peripheral frame extending at least partially around the second back panel, and further comprising at least one second retention element positioned on the second peripheral frame; and at least one tension member connected between the first and second retention elements, the at least one tension member retaining the first and second shells in operative engagement with one another as they move through a range of motion between an open configuration and a closed configuration; and wherein the first and second retention elements comprise holding posts protruding from the first and second shells, each of the holding posts comprising a groove for receiving cooperative engagement features of the tension member.

9. The case of claim 8, wherein at least one of the first and second shells comprise a hard plastic portion and a soft plastic portion.

10. The case of claim 8, further comprising at least one case button, wherein the case button is operably aligned with a user input actuator of the electronic device when the case is installed on the device.

11. The case of claim 8, wherein the at least one tension member comprises a spring.

12. The case of claim 8, wherein the at least one tension member comprises an elastic band.

13. The case of claim 8, wherein the front shell and the back shell define one or more apertures positioned to align with corresponding features of the electronic device.

14. The case of claim 8, further comprising a device hinge protection plate, wherein the device hinge protection plate includes a top wall with a first bore extending therethrough and a bottom wall with a second bore extending therethrough, and wherein a first tension member extends through the first bore and a second tension member extends through the second bore.

* * * * *